US009249700B2

(12) United States Patent
Kai et al.

(10) Patent No.: US 9,249,700 B2
(45) Date of Patent: Feb. 2, 2016

(54) OIL PUMP UNIT WITH VARIABLE FLOW RATE

(75) Inventors: Keiichi Kai, Isesaki (JP); Junichi Miyajima, Isesaki (JP); Noriyuki Kawamata, Wako (JP); Toshimasa Mitsubori, Wako (JP); Satoshi Ino, Wako (JP)

(73) Assignees: YAMADA MANUFACTURING CO., LTD., Kiryu-Shu (JP); HONDA MOTOR CO., LTD., Tokyo (JP)

( * ) Notice: Subject to any disclaimer, the term of this patent is extended or adjusted under 35 U.S.C. 154(b) by 1025 days.

(21) Appl. No.: 13/228,984

(22) Filed: Sep. 9, 2011

(65) Prior Publication Data

US 2012/0070317 A1 Mar. 22, 2012

(30) Foreign Application Priority Data

Sep. 16, 2010 (JP) ..... P2010-208450

(51) Int. Cl.
*F01M 1/02* (2006.01)
*F04B 41/06* (2006.01)
(Continued)

(52) U.S. Cl.
CPC . *F01M 1/02* (2013.01); *F01M 1/16* (2013.01); *F04B 41/06* (2013.01); *F04B 49/22* (2013.01); *F01M 2001/0238* (2013.01); *F01M 2001/0246* (2013.01)

(58) Field of Classification Search
CPC ..... F04B 23/12; F04B 41/06; F04B 49/002; F04B 49/08; F04B 49/22; F04C 11/001; F04C 14/24; F04C 14/26; F04C 14/02; F04C 14/0653; F16N 13/18; F16N 13/04; F16N 13/20; F16N 13/10; F16N 13/02; F16N 13/12; F16N 13/14; F16N 7/04; F16N 7/366; F16N 9/04; F01M 1/02; F01M 1/16; F01M 2001/0246; F01M 2001/0238; G05D 11/005; G05D 11/02; G05D 16/10; G05D 16/103
USPC ..... 417/213, 216, 287, 427; 123/196 R; 184/26, 27.1, 27.2, 31, 32; 137/114
See application file for complete search history.

(56) References Cited

U.S. PATENT DOCUMENTS 2,549,897 A * 4/1951 Evrell ..... 137/114
2,993,445 A * 7/1961 Fritz ..... 417/288
(Continued)

FOREIGN PATENT DOCUMENTS

JP 44-013019 Y 5/1969
JP 2007-255227 10/2007

OTHER PUBLICATIONS

German Office Action, Application No. 102011082517.7, mailed Sep. 20, 2012, 22 pages.
(Continued)

*Primary Examiner* — Devon Kramer
*Assistant Examiner* — Joseph Herrmann
(74) *Attorney, Agent, or Firm* — Rankin, Hill & Clark LLP

(57) ABSTRACT

An oil pump unit with a variable flow rate includes: an oil pump having an intake port and a discharge port and accommodating a pump rotor; and an oil path switching valve having oil inlets and oil outlets and opening/closing oil pressure return holes communicating with the discharge port, in which the oil path switching valve and the oil pump are separately disposed, the intake port and the discharge port are open to valve-mounting surfaces formed at the oil pump, and oil inlets and the oil outlet are open to body-mounting surfaces matching with the valve-mounting surfaces of the oil path switching valve.

4 Claims, 10 Drawing Sheets

(51) Int. Cl.
*F04B 49/22* (2006.01)
*F01M 1/16* (2006.01)

(56) References Cited

U.S. PATENT DOCUMENTS 3,535,877 A * 10/1970 Becker et al. ..... 60/422
3,751,190 A * 8/1973 Cecchi ..... 417/288
5,797,732 A 8/1998 Watanabe et al.
7,588,011 B2 * 9/2009 Ono et al. ..... 123/196 R
2008/0107545 A1 * 5/2008 Hoji ..... 417/307
2008/0190496 A1 * 8/2008 Ono et al. ..... 137/565.15

OTHER PUBLICATIONS

Japanese Office Action and English Translation, Application No. 2010-208450, mailed Dec. 21, 2012, 4 pages.

* cited by examiner

OIL PUMP UNIT WITH VARIABLE FLOW RATE

BACKGROUND OF THE INVENTION

1. Field of the Invention

The present invention relates to an oil pump unit with a variable flow rate that is suitable for an engine of a vehicle.

2. Description of Related Art

In the related art, as the oil pump with a variable flow rate, there has been disclosed an oil pump with a variable flow rate that includes a pump body having an intake port and a discharge port and accommodating a pump rotor and a flow path switching valve having an oil inlet and an oil outlet and opening/closing a hydraulic pressure returning hole that communicates with the discharge port (for example, see Japanese Unexamined Patent Application, First Publication No. 2007-255227).

SUMMARY OF THE INVENTION

In the configuration of the related art, although the valve body accommodating the valve main body of the oil path switching valve is integrally formed with the pump body and a channel is appropriately formed in the pump body, there is a problem in that the channel structure is complicated or it is required to block the channel forming opening with a blocking plate, and the number of the manufacturing processes and the parts of the entire pump are easily increased.

It is an object of the present invention to improve productivity and reduce the cost and weight by suppressing an increase in the numbers of the manufacturing processes and the parts of the entire pump, in an oil pump unit with a variable flow rate equipped with an oil path switching valve that opens/closes an oil pressure return hole.

According to a first aspect of the present invention, an oil pump unit with a variable flow rate includes: an oil pump having an intake port and a discharge port and accommodating a pump rotor; and an oil path switching valve having oil inlets and oil outlets and opening/closing oil pressure return holes communicating with the discharge port, wherein: the oil path switching valve and the oil pump are separately disposed, the intake port and the discharge port are open to valve-mounting surfaces formed at the oil pump, and the oil inlet and the oil outlet are open to body-mounting surfaces matching with the valve-mounting surfaces of the oil path switching valve.

According to a second aspect, a plurality of pump rotors are disposed on the same shaft; and the intake port and the discharge port, which correspond to each of the pump rotor, are disposed opposite to each other in the axial direction of the pump.

According to a third aspect, the oil path switching valve is disposed under a pump driving shaft.

According to a fourth aspect, the pump rotor include a first pump rotor and a second pump rotor; a first oil path switching portion that switches the oil path of the first pump rotor in the oil path switching valve is disposed at an one side in the valve-longitudinal direction of the oil path switching valve; and a second oil path switching valve that switches the oil path of the second pump rotor in the oil path switching valve is disposed at an other end of the oil path switching valve in the valve-longitudinal direction.

According to a fifth aspect, oil inlets that are kept communicating with the discharge port of the first pump rotor are disposed at the first oil path switching portion, the one valve-longitudinal end of a valve body in the oil path switching valve is disposed facing oil inlets, and an oil pressure receiving portion that receives oil pressure from oil inlets is disposed at the one valve-longitudinal end of the valve body.

According to a sixth aspect, the valve body has a first valve portion disposed facing the first oil path switching portion, a second valve portion disposed facing the second oil path switching portion, and a connecting portion connecting first and second valve portions with each other; first and second valve portions open/close the oil inlet and the oil outlet by bringing outer circumferential surfaces thereof in sliding contact with an inner circumferential surface of the flow path switching valve; and a space through which oil passes is defined between the connecting portion and the inner circumferential surface of the oil path switching valve.

The second valve portion is open to other valve-longitudinal end of the valve body and accommodates an urging member that urges the valve body toward the one valve-longitudinal end.

According to an eighth aspect, a cylindrical extender extends from the second valve portion, accommodates a coil spring, and guides an extension/contraction of the coil spring that is the urging member; and the other valve-longitudinal end of the extender is a stopper that hits against the valve-longitudinal end of the flow path switching valve.

According to a ninth aspect, first and second pump rotors have different discharge rates; and a valve-longitudinal width of one of the first and second oil path switching portions, which corresponds to one of the first and second pump rotors which has a larger discharge rate than the other pump rotor's discharge rate, is larger than the other valve-longitudinal width of the oil path switching portion.

According to the invention described in the first aspect, in the pump body and the valve body, which are separate parts, the intake port and the discharge port are open to the valve-mounting surface of the pump body while the oil inlet and the oil outlet are open to the body-mounting surface of the valve body, such that it is possible to simultaneously form the intake port and the discharge port when forming the pump body and simultaneously form the oil inlet and the oil outlet when forming the valve body and it is not required to disposed a member for close the openings; therefore, it is possible to improve productivity and reduce the cost and weight by suppressing an increase in the number of the manufacturing processes and the parts of the entire pump.

According to the invention described in the second aspect, it is possible to dispose the intake port and the discharge port, which correspond to first and second pump rotors close to each other and it is possible to shorten and simplify the channel between the intake port and the discharge port and the oil path switching valve.

According to the invention described in the third aspect, it is possible to improve air permeability as compared with when the oil path switching valve is disposed above the pump driving shaft and it is also possible to make the valve operability better because the oil collects under the pump (the oil path switching valve).

According to the invention described in the fourth aspect, each of first and second oil path switching portions are arranged in the valve-longitudinal direction of the valve body, and it is possible to not complicate, but simplify the channel structure of the oil path switching vale and it is also possible to reduce the entire size of the pump, even if a plurality of pump rotors are provided.

According to the invention described in the fifth aspect, it is possible to improve productivity by making it easy to form the oil pressure receiving portion while easily operating the oil path switching valve by using the oil pressure from the first pump rotor.

According to the invention described in the sixth aspect, it is possible to minutely reduce the weight of the connecting portion by narrowing that connects first and second valve portions while integrally operating the valve main body having first and second valve portions, and it is also possible to use the space outside the connecting portion to switch the channel.

According to the invention described in the seventh aspect, it is possible to make the oil path switching valve compact in the longitudinal direction.

According to the invention described in the eighth aspect, it is possible to limit the movement of the valve main body to the other end of the valve main body in the longitudinal direction by using the guide member and the operation by the urging member of the valve main body come better.

According to the invention described in the ninth aspect, the oil path switching range of one of the first and second oil path switching portions which corresponds to first and second pump rotors having a large discharge amount increases, such that it is possible to increase the capacity switching width of the entire pump.

DETAILED DESCRIPTION OF THE INVENTION

Hereinafter, the embodiments of the present invention are described with reference to the drawings. Further, in the following description, the front/rear/left/right directions are the direction based on a vehicle described below if not specifically stated. Further, an arrow of FR showing the front of the vehicle, an arrow LH showing the left of the vehicle, and an arrow UP showing the upper direction of the vehicle are shown at appropriate positions in the figures used in the following description.

Figure 1:
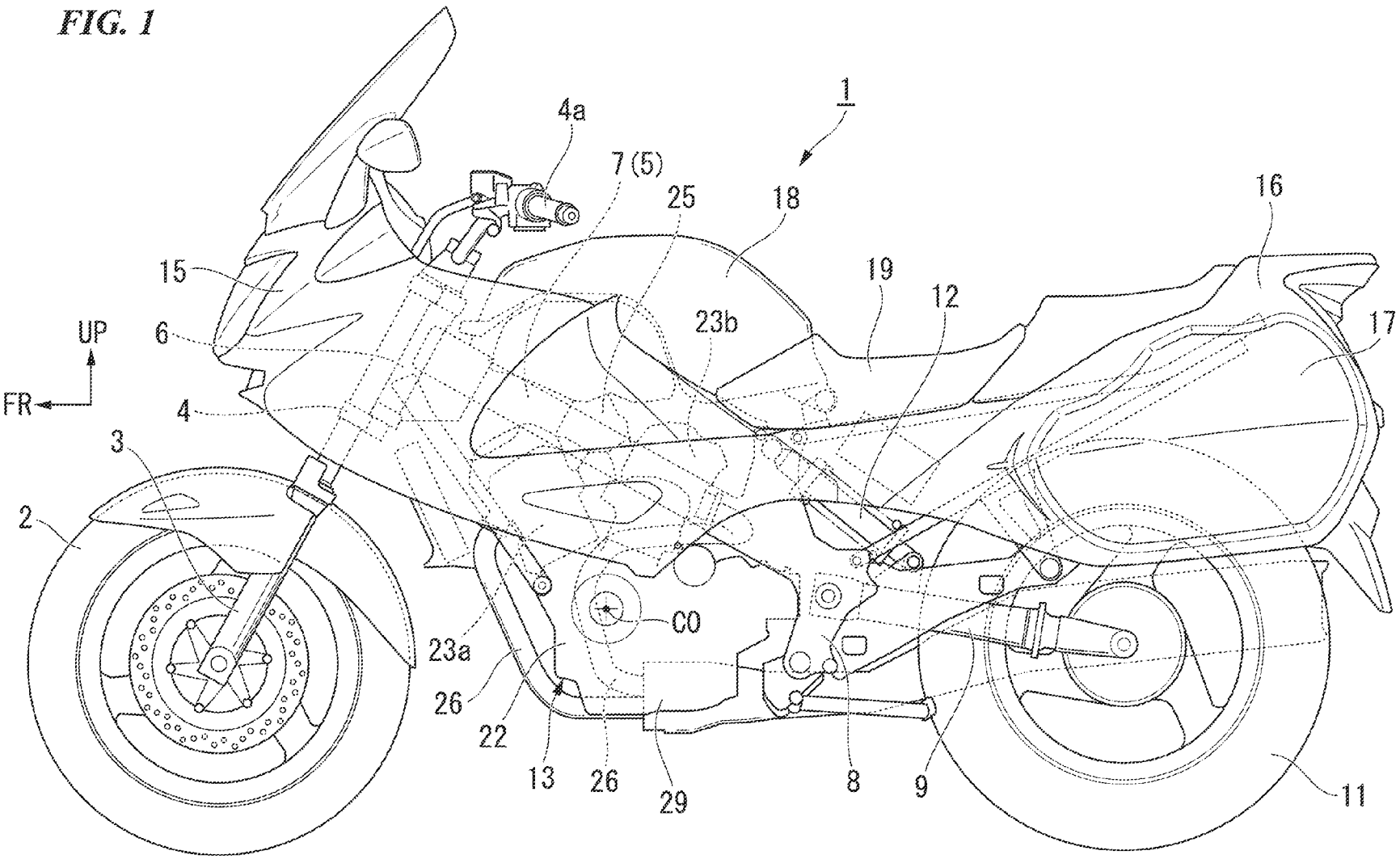
FIG. 1 is a left side view of a motorcycle according to an embodiment of the present invention.

In a motorcycle 1 (a saddle-typed vehicle) shown in FIG. 1, a front wheel 2 is supported by a shaft at the lower end portion of a front fork 3. The upper portion of the front fork 3 is steerably supported by a shaft at a head pipe 6 at the front end of a bodywork frame 5 through a steering stem 4. A steering handle 4*a* is mounted on the upper portion of the steering stem 4(or the front fork 3). A main frame 7 extends rearward from the head pipe 6 and is connected to a pivot frame 8. The front end portion of a swing arm 9 is vertically swingably supported by a shaft at the pivot frame 8. A rear wheel 11 is supported by a shaft at the rear end portion of the swing arm 9. A cushion unit 12 is disposed between the swing arm 9 and the bodywork frame 5. An engine (internal combustion engine) 13 that is the motor of the motorcycle 1 is mounted in the bodywork frame 5.

The left arm of the swing arm 9 is hollow and a drive shaft introduced from the engine 13 is inserted in the left arm. Power is transmitted between the engine 13 and the rear wheel 11 through the drive shaft.

The front portion of the bodywork of the motorcycle 1 is covered by a front cowl 15 and the rear portion of the bodywork is covered by a rear cowl 16. Left and right pannier cases 17 are built in both read sides of the rear cowl 16. A fuel tank 18 is disposed above the main frame 7 and a seat 19 is disposed behind the fuel tank 18.

Figure 2:
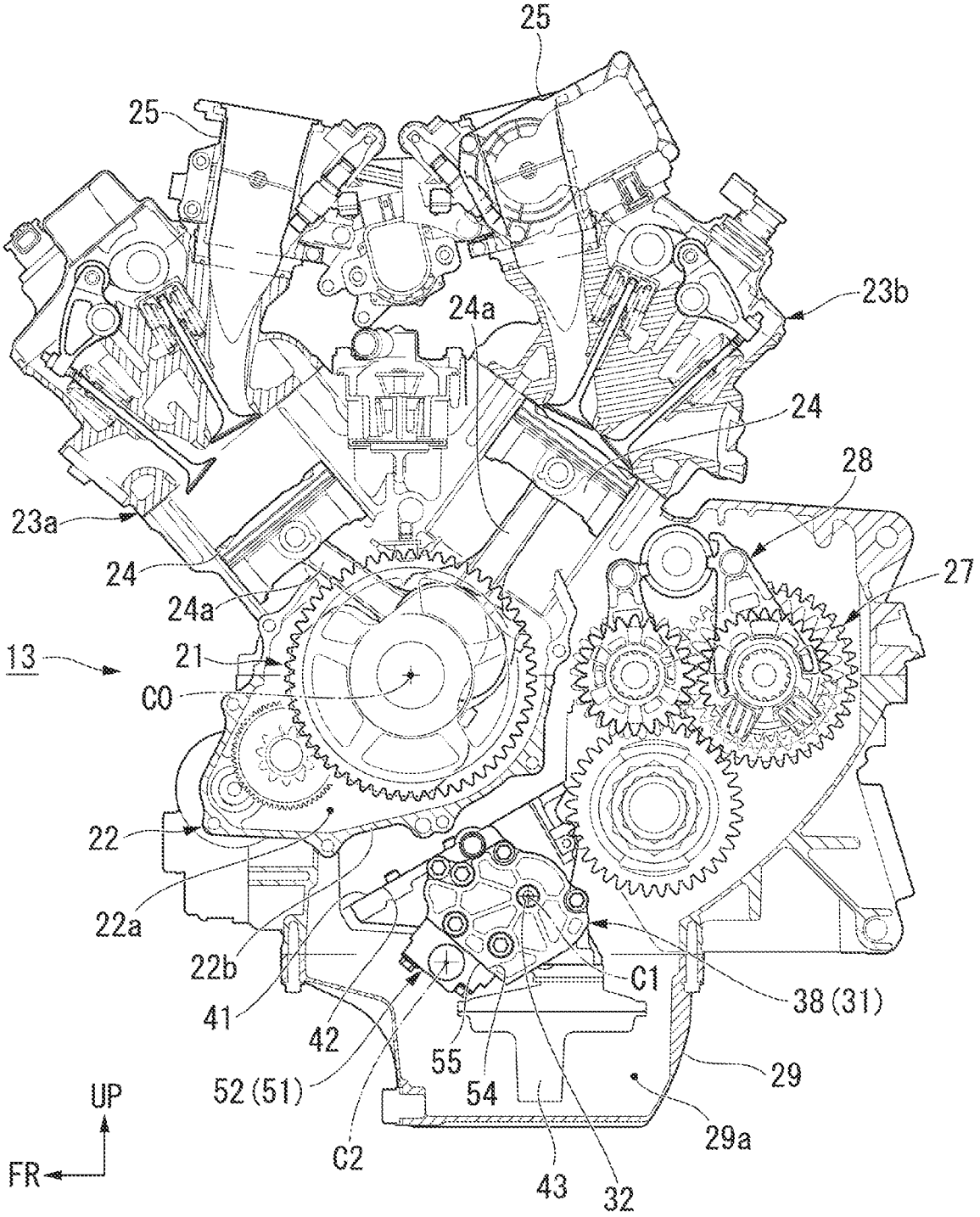
FIG. 2 is a left side view of an engine of the motorcycle.

Referring to FIG. 2, the engine 13 is a V-type engine with the rotational axial center line C0 of a crankshaft 21 is arranged in the vehicle width direction (left-right direction) and front and rear cylinders 23*a* and 23*b* are vertically disposed on a crank case 22. Pistons 24 are mounted to be able to reciprocate in the front and rear cylinders 23*a* and 23*b*, respectively, the reciprocation motion of the pistons 24 is converted into a rotation motion of the crankshaft 21 through a con rod 24*a*.

A throttle body 25 connected to the intake port is disposed between the front and rear cylinders 23*a* and 23*b*. An exhaust pipe 26 extending from the exhaust port is disposed ahead of the front cylinder 23*a* or behind the rear cylinder 23*b*.

Further, reference numeral "27" in the figure indicates a transmission accommodated in the rear portion of the crank case 22, reference numeral "28" indicates a change mechanism that switches the shift stages of the transmission 27, reference numeral "29" indicates an oil pan mounted at the lower portion of the crank case 22, and reference numeral "31" indicates an oil pump unit that sends an engine oil (hereafter, briefly referred to as an oil) in the oil pan 29 to each part of the engine under pressure.

Figure 3:
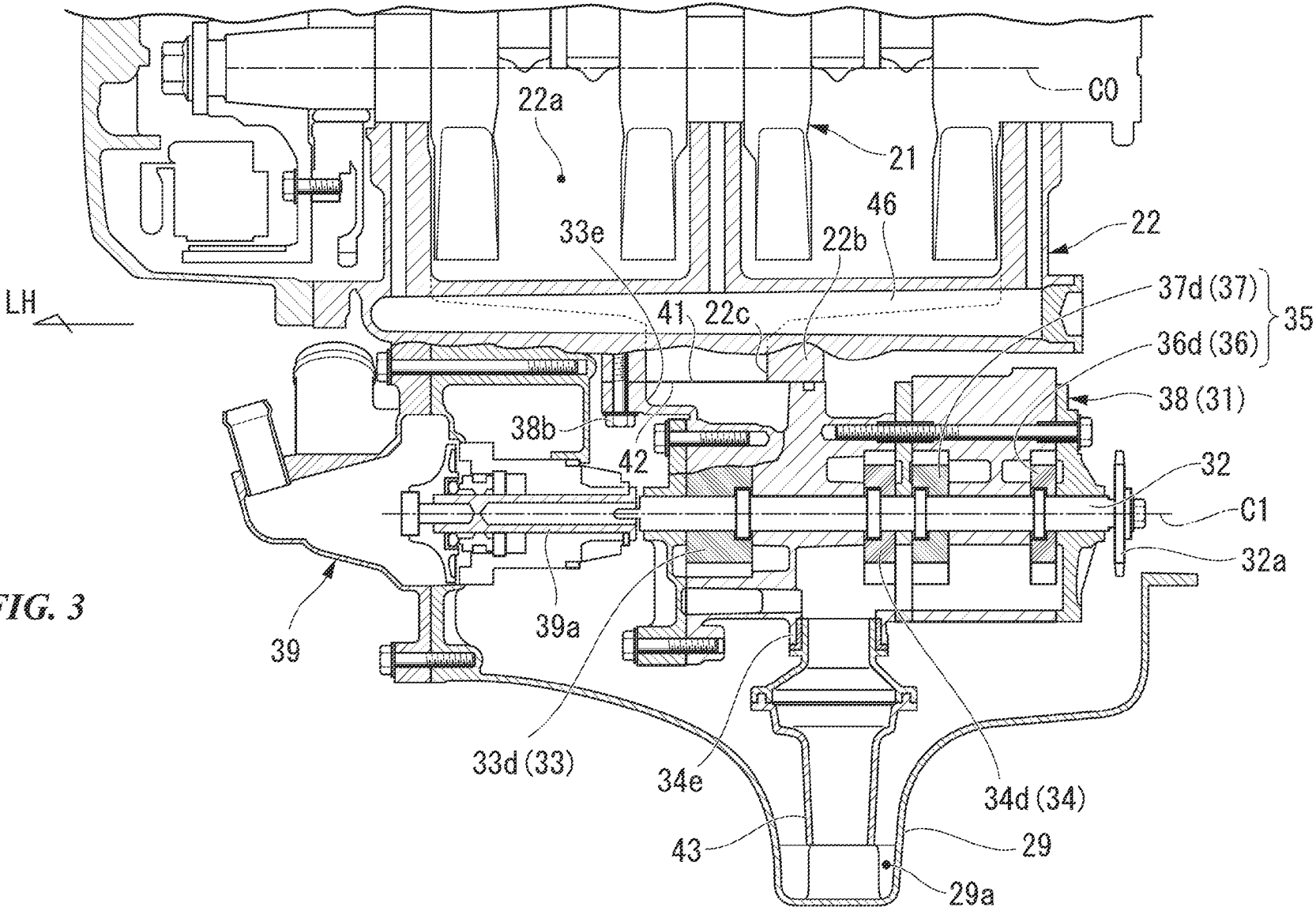
FIG. 3 is a cross-sectional view of the main parts of the engine, cut in parallel with the axial line of a crank shaft and seen from the rear.
Figure 4:
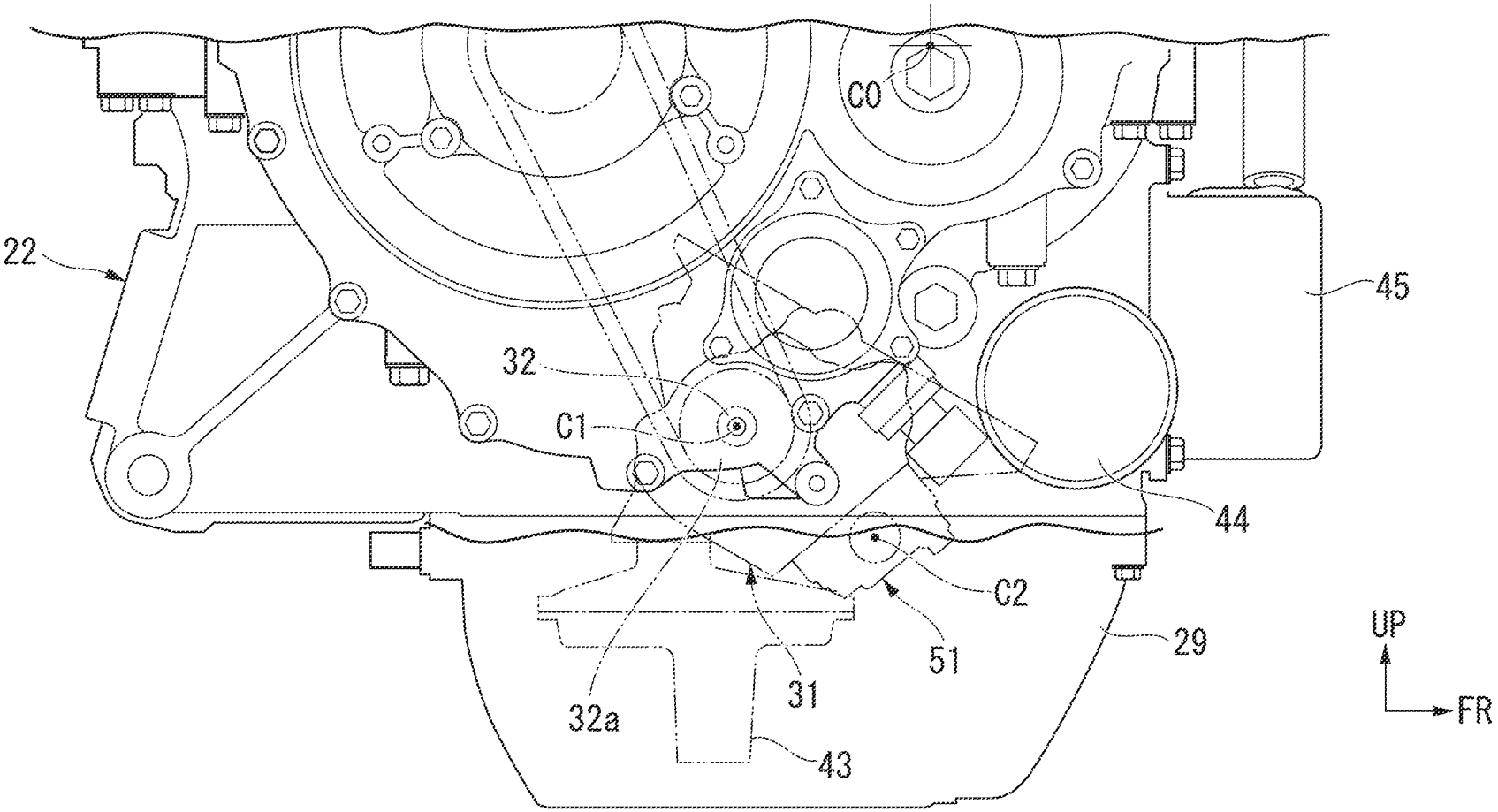
FIG. 4 is a right side view of the main parts of the engine.

Referring to FIGS. 2 to 4, the oil pump unit 31 is driven by rotation of a rotary member (crankshaft 21 or a clutch outer of a multiple disc clutch to which the rotational power is kept transmitted) which is mounted inside the lower portion of the crank case 22 and keeps rotating when the engine is operated. The oil pump unit 31 includes a pump driving shaft 32 (hereafter, briefly referred to as a driving shaft) that is in parallel with the crankshaft 21. A driven member 32*a* (a driven sprocket) for operation with the rotary member is integrally rotatably mounted at the right end portion of the driving shaft 32. Further, reference numeral 'C1' indicates the rotation center axial line of the driving shaft 32.

Referring to FIG. 3, the oil pump unit 31 has a configuration in which a plurality of trochoidal type oil pumps is arranged in the left-right direction (in parallel with the crankshaft line C0).

In detail, the oil pump unit 31 has a configuration in which a scavenge pump 33, a feed pump 34, and a control pump 35 that generates an oil pressure for controlling an apparatus, such as a transmission or a valve gear, are sequentially arranged on the same axis from the left side.

The feed pump 34 sends the oil in the oil pan 29 under the crank case 22 toward oil supply positions of each part of the engine under pressure. The scavenge pump 33 returns the oil from a space (hereafter, referred to as a crank chamber 22*a*) accommodating the crankshaft 21 to a space (hereafter, referred to as an oil pan chamber 29*a*) in the oil pan 29, in the crank case 22. The control pump 35 supplies an oil pressure for the operation to the apparatus. Further, reference numeral '22*b*' in the figure indicates the bottom wall of the crank chamber 22*a*.

Figure 5:
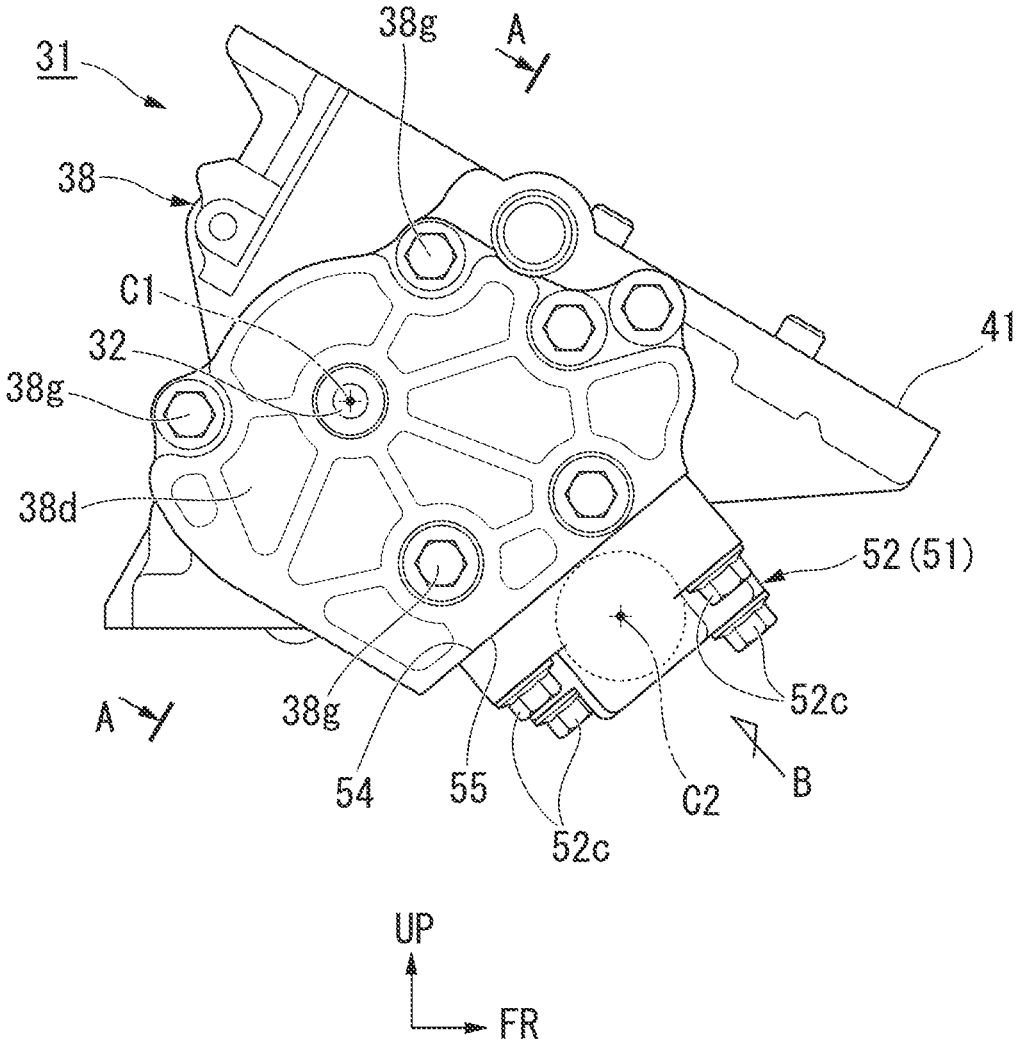
FIG. 5 is a right side view of an oil pump unit of the engine.
Figure 6:
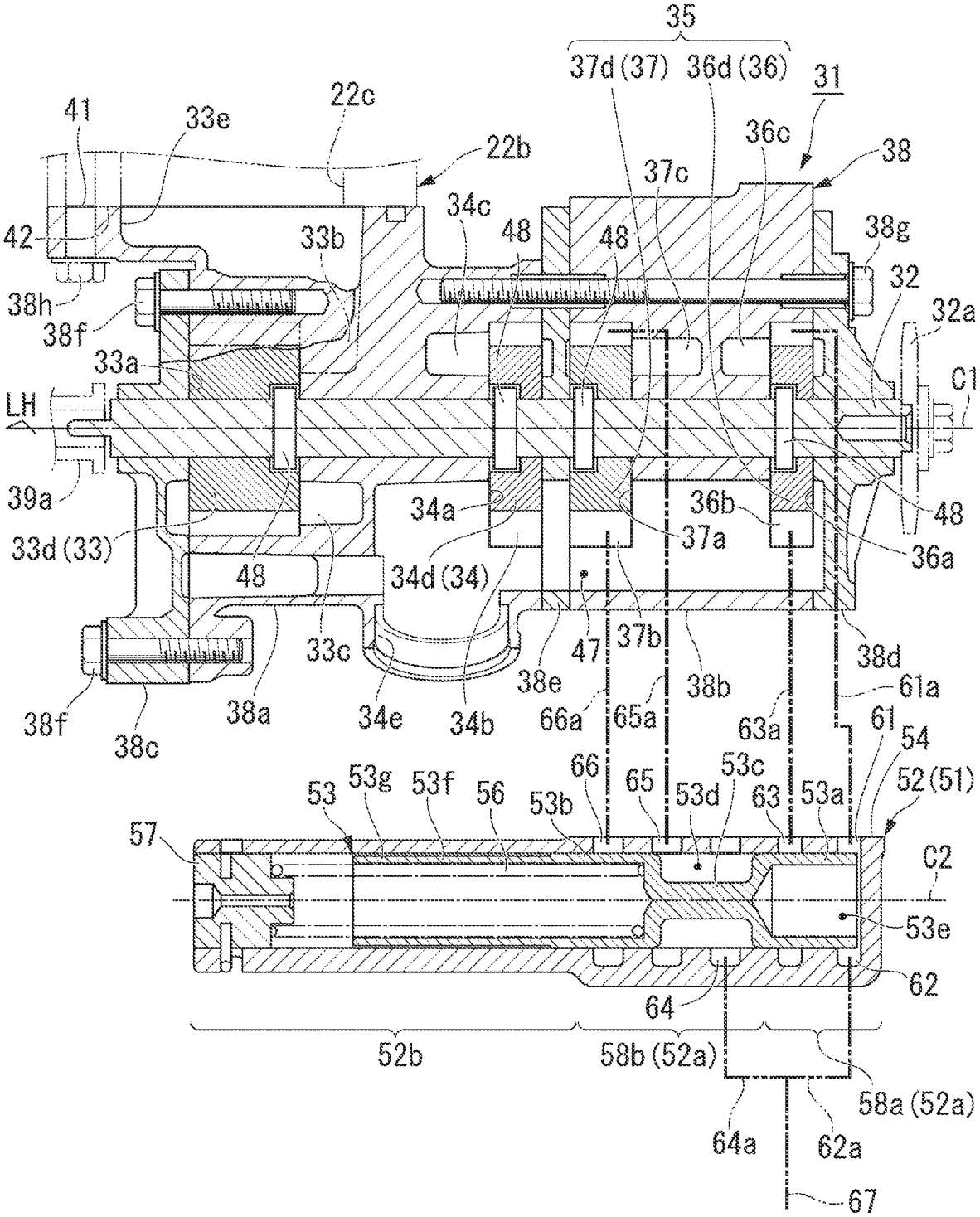
FIG. 6 is an illustrative view adding the cross-sectional view of an oil path switching valve to the cross-sectional view taken along the line A-A of FIG. 5.

Referring to FIGS. 5 and 6, the oil pump unit 31 includes a single pump body 38 and a driving shaft 32 and the pumps 33, 34, and 35 share them. The right end portion of the driving shaft 32 protrudes from the right end of the pump body 38 and the driven member 32*a* is fixed to the right end portion of the driving shaft 32. The left end portion of the driving shaft 32 protrudes from the left end of the pump body 38 and the right end portion of a driving shaft 39*a* of a water pump 39 (see FIG. 3) is integrally rotatably engaged with the left end portion of the driving shaft 32. That is, the water pump 39 includes the driving shaft 39*a* arranged in the left-right direction and the driving shaft 39*a* is disposed on the shame axis of the driving shaft 32 of the oil pump unit 31.

The pump body 38 is divided into a left section 38*a* that forms rotor receiving portions 33*a* and 34*a* for the feed pump 34 and the scavenge pump 33 and intake ports 33*b* and 34*b* and discharge ports 33*c* and 34*c*, a right section 38*b* that forms rotor receiving portions 36*a* and 37*a* for first and second oil pumps 36 and 37, which are described below, and intake ports 36*b* and 37*b* and discharge ports 36*c* and 37*c* in the control pump 35, a left cover body 38*c* that closes the left end of the left section 38*a*, a right cover body 38*d* that closes the right end of the right section 38*b*, and a separating plate 38*e* that is interposed between the left and right sections 38*a* and 38*b*.

The left cover body 38*c* is fastened and fixed to the left end of the left section 38*a* by a plurality of bolts 38*f* and the right cover body 38*d* is fastened and fixed to the right end of the left section 38*a* by a plurality of long bolts 38*g* passing through the right section 38*b* and the separating plate 38*e*. Accordingly, the sections 38*a* and 38*b*, the cover bodies 38*c* and 38*d*, and the separating plate 38*e* are integrally combined.

The rotor receiving portions 33*a* and 34*a* accommodate rotors 33*d* and 34*d* of the feed pump 34 and the scavenge pump 33, respectively. The pump rotor 33*d* and 34*d* each have a configuration composed of an outer rotor and an inner rotor, which is known in the art. Each of the pump rotor 33*d* and 34*d* (inner rotors) can rotate integrally with the driving shaft 32 held at the center portion of the pump body 38.

Referring to FIG. 2, an engine-mounting surface 41 that is inclined forward and downward when the oil pump unit 31 is mounted on the engine 13 (motorcycle 1) is formed at the upper left portion of the pump body 38. The engine-mounting surface 41 is flat in the left-right direction and aligned in oil tight from under a pump-mounting surface 42 under the bottom wall 22*b* of the crank chamber 22*a*. In this state, the pump body 38 (oil pump unit 31) is fastened and fixed to the bottom wall 22*b* of the crank chamber 22*a* by a plurality of bolts 38*h*.

Referring to FIG. 6, the intake port 33*b* of the scavenge pump 33 is formed at the upper left side of the left section 38*a*. The intake port 33*b* extends toward the engine-mounting surface 41 above it and is opened at the engine-mounting surface 41 by an intake hole 33*e*. An opening 22*c* is formed at the pump-mounting surface 42 of the bottom wall 22*b* of the crank chamber 22*a*, opposite to the intake hole 33*e*. The intake hole 33*e* and the opening 22*c* communicate with each other, with an oil pump unit 31 mounted on the crank case 22.

The discharge port 33*c* that is open to the oil pan chamber 29*a* in the scavenge pump 33 is formed at the lower right side of the left section 38*a*. Accordingly, when the oil pump unit 31 is driven, the scavenge pump 33 sucks the oil in the crank chamber 22*a* through the intake port 33*b* and discharges and returns the oil to the oil pan chamber 29*a* through the discharge port 33*c*.

Referring to FIG. 2, the bottom wall 22*b* that is a separating wall separating the crank chamber 22*a* and the oil pan chamber 29*a* is formed in an arch shape along the rotation path of a crank web when seen from a side. The opening 22*c* is formed at the lower end portion of the bottom wall 22*b*.

Referring to FIGS. 3 and 4, the intake port 34*b* of the feed pump 34 is formed at the lower right side of the left section 38*a*. The intake port 34*b* opens the intake port 34*e* toward the oil pan chamber 29*a*, extending in a nozzle shape under it. The upper end portion of a strainer 43 sunk in the oil in the oil pan chamber 29*a* is connected to the intake port 34*e*.

The discharge port 34*c* that communicates with an oil supply channel to each part of the engine in the feed pump 34 is formed at the upper right side of the left section 38*a*. Accordingly, when the oil pump unit 31 is driven, the feed pump 34 sucks the oil in the oil pan chamber 29*a* through the strainer 43 by the intake port 34*b* and discharges and returns the oil to each part of the engine through the discharge port 34*c*. The oil discharged by the feed pump 34 reaches to a main oil gallery 46, for example, through an oil filter 44 and an oil cooler 45, and then is appropriately supplied to oil supply positions of each part of the engine.

Referring to FIG. 6, a communication space 47 that includes the intake port 34*b* of the feed pump 34 and the intake port 36*b* and 37*b* of the first and second oil pumps 36 and 37 of the control pump 35 and extends to the left and right is formed at the lower portion of the pump body 38. The feed pump 34 and the first and second oil pumps 36 and 37 suctions the oil introduced in the communication space 47 through the strainer 43 through the intake port 34*b*, 36*b*, and 37*b*.

The control pump 35 includes the first oil pump 36 and the second oil pump 37 arranged in parallel along the driving shaft 32 (in the left-right direction, hereafter, referred to as a pump axis direction).

The first oil pump 36 is a main pump that keeps communicate with an oil supply channel 67 extending to each part of the engine (the apparatus) and the second oil pump 37 is a sub-pump that switches the oil supply channel 67 to communicate or not by operation of an oil path switching valve 51, which is described below.

The first oil pump 36 accommodates the first pump rotor 36*d* in the right oil receiving portion 36*a* of the right section 38*b* and the second oil pump 37 accommodates the second pump rotor 37*d* in the left rotor receiving portion 37*a* of the right section 38*b*. That is, the first oil pump 36 is disposed at the outer side of the pump body 38 than the second oil pump 37 in the pump axis direction. The driven member 32*a* is disposed at the outer side than the first oil pump 36 in the pump axis direction.

The intake port 36*b* and 37*b* of the first and second oil pumps 36 and 37 are open to the communication space 47 and the discharge port 36*c* and 37*c* of the first and second oil pumps 36 and 37 are separately open to the upper portion of the pump body 38.

The intake port 33*b*, 34*b*, 36*b*, and 37*b* of the first and second oil pumps 36 and 37, the feed pump 34, and the scavenge pump 33 are disposed in parallel in the pump axis direction. Similarly, the discharge port 33*c*, 34*c*, 36*c*, and 37*c* of the first and second oil pumps 36 and 37, the feed pump 34, and the scavenge pump 33 are also disposed in parallel in the pump axis direction.

The pump rotor 36*d* and 37*d* each have a configuration composed of an outer rotor and an inner rotor, which is known in the art. Each of the pump rotor 36*d* and 37*d* (inner rotors) can rotate integrally with the driving shaft 32. The width (thickness) of the second pump rotor 37*d* in the pump axis direction is about two times the first pump rotor 36*d*. That is, the basic discharge amount per rotation of the second oil pump 37 (pump capacity) is about two times the first oil pump 36.

In this configuration, the first and second oil pumps 36 and 37 has the same discharge cycle, but has about half-cycle phase difference, such that generation of vibration of the lubrication system is suppressed.

Figure 7:
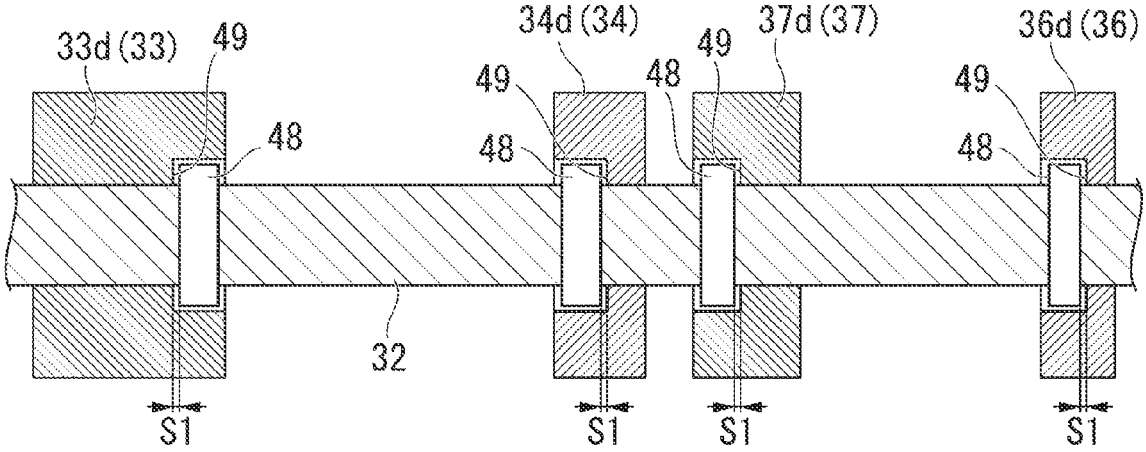
FIG. 7 is an enlarged view of the main parts of FIG. 6.

Referring to FIG. 7, a plurality of fitting pins 48 that integrally rotatably fit the pump rotors 33*d*, 34*d*, 36*d*, and 37*d* of the first and second oil pumps 36 and 37, the feed pump 34, and the scavenge pump 33 is fixed to the driving shaft 32. Fitting grooves 49 that is fitted on the corresponding fitting pin 48 are formed at the left sides of the pump rotors 34*d*, 36*d*, and 37*d* of the first and second oil pumps 36 and 37 and the feed pump 34 while a fitting groove 49 that fits the corresponding fitting pin 48 is formed at the right surface of the pump rotor 33*d* of the scavenge pump 33.

Further, a gap s1 in the axial direction of the driving shaft 32 (in the pump axial direction) is defined between the fitting pins 48 and the bottom surfaces of the fitting grooves 49, respectively.

The oil sucked in the first and second oil pump 36 and 37 is appropriately supplied to at least one of first and second return channel 63*a* and 66*a* reaching first and second oil supply channels 62*a* and 64*a*, which meets the oil supply channel 67, and the intake port 36*b* and 37*b*, through the oil path switching valve 51 after being discharged through the discharge port 36*c* and 37*c*.

Referring to FIG. 6, the oil path switching valve 51 is implemented a so-called spool valve that selectively switches the discharge port 36*c* and 37*c* to communicate or not with the first and second oil pumps 36 and 37, the first and second oil supply channels 62*a* and 64*a*, and the first and second return channels 63*a* and 66*a*. The oil path switching valve 51 has a cylindrical valve body 52 in the longitudinal direction (left-right direction) and a valve main body 53 inserted in the valve body 52 to be able to reciprocate in the left-right direction. The oil path switching valve 51 is disposed under the driving shaft 32 when being mounted on the engine 13 (motorcycle 1) (see FIGS. 2 and 5). Further, reference numeral 'C2' indicates the center axis line of the oil path switching valve 51.

Referring to FIGS. 5 and 6, the valve body 52 is disposed separately from the pump body 38. A body-mounting surface 54 that is inclined rearward and downward when being mounted on the engine 13 is formed at the upper rear side of the right portion of the valve body 52 (an oil path forming portion 52*a* described below). The body-mounting surface 54 is flat in the left-right direction and aligned in oil tight from under the valve-mounting surface 55 formed at the lower portion of the valve body 52.

In this state, the valve body 52 is fastened and fixed to the pump body 38 by a plurality of bolts 52*c*.

The left end of the valve body 52 is open to the left, and the valve main body 53 and a compression coil spring (hereafter, briefly referred to as a spring) 56 that urges the right side of the valve main body are inserted in the valve body 52 by the left end. The left end of the valve body 52 is closed by an end cap 57 and the spring 56 is compressed at a predetermined amount between the end cap 57 and the valve main body 53.

A first inlet 61 that communicates with the discharge port 36*c* of the first oil pump 36 through the first introducing channel 61*a*, a first return hole 63 that is communicates with the intake port 36*b* of the first oil pump 36 through the first return channel 63*a*, a second outlet 64 that communicates with the second oil supply channel 64*a*, a second inlet 65 that communicates with the discharge port 37*c* of the second oil pump 37 through the second introducing channel 65*a*, and a second return hole 66 that communicates with the intake port 37*b* of the second oil pump 37 through the second return channel 66*a* are sequentially provided from the right end, at the right end portion of the valve body 52. The first inlet 61 includes the first inlet 62 that communicates with the first oil supply channel 62*a*.

Hereinafter, it is assumed that in the oil path switching valve 51, the portion (right portion) where the inlets 61 and 65, the outlets 62 and 64, and the return holes 63 and 66 are formed is an oil channel forming portion 52*a* and the portion (left portion) that extends from the above portion and mainly accommodates the spring 56 is a driving portion 52*b*.

Figure 10:
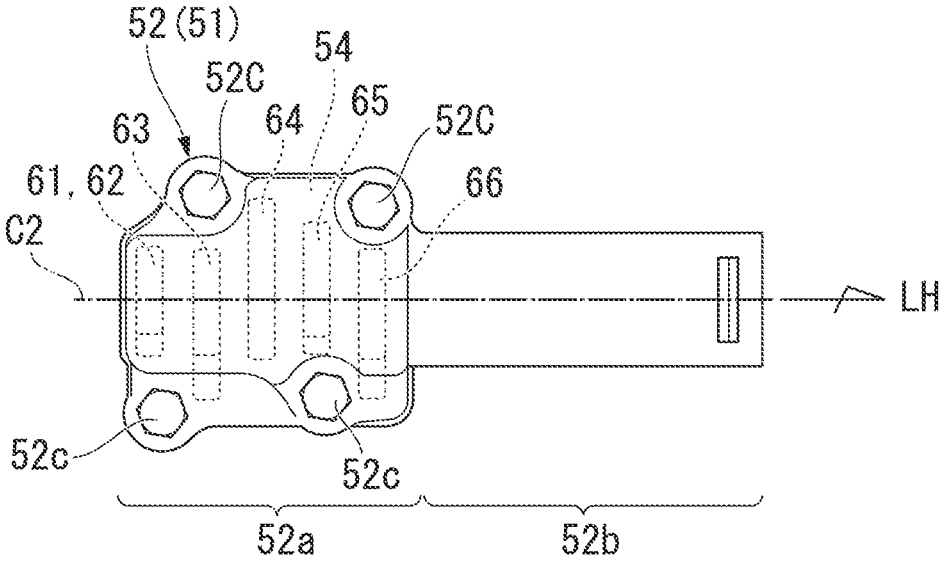
FIG. 10 is a view of the oil path switching valve seen in the B-direction of FIG. 5.
Figure 11:
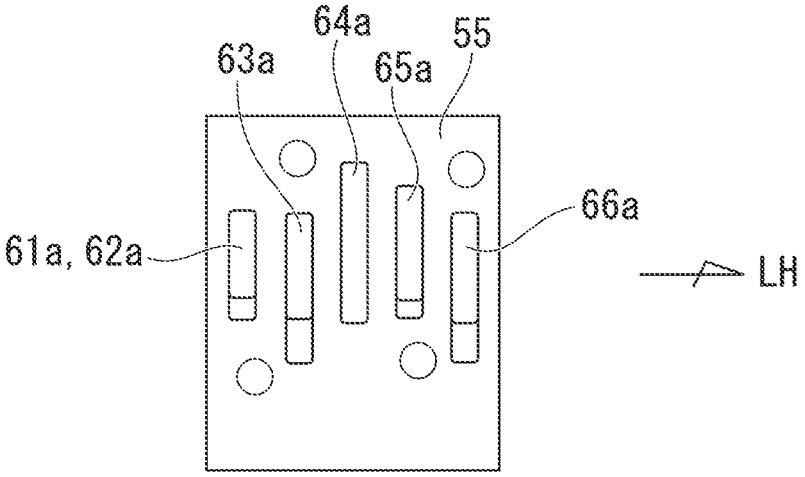
FIG. 11 is a view of a valve mounting surface of the oil pump unit, seen in the B-direction of FIG. 5.

Referring to FIGS. 10 and 11, the first inlet 61 (first outlet 62), the first return hole 63, the second leasing hole 64, the second inlet 65, and the second return hole 66 are sequentially open from the left side in a slit shape perpendicular to the pump axis direction, on the body-mounting surface 54 formed at the upper rear side of the oil forming portion 52*a*.

Meanwhile, the first introducing channel 61 a (first oil supply channel 62*a*), the first return channel 63*a*, the second oil supply channel 64*a*, the second introducing channel 65*a*, and the second return channel 66*a* are open in a slit shape perpendicular to the pump axis direction, on the valve-mounting surface 55 formed at the lower front portion of the pump body 38.

In other words, on the valve-mounting surface 55, the discharge port 36*c* of the first oil pump 36 is open through the first introducing channel 61*a*, the intake port 36*b* of the first oil pump 36 is open through the first return channel 63*a*, the discharge port 37*c* of the second oil pump 37 is open through the second introducing channel 65*a*, and the intake port 37*b* of the second oil pump 37 is open through the second return channel 66*a*.

Referring to FIG. 6, the right portion of the valve main body 53 is a first valve portion 53*a* having a cylindrical shape with a bottom that is open to the right and the left portion of the valve main body 53 is a second valve portion 53*b* having a cylindrical shape with a bottom that is open to the left. The first valve portion 53*a* is inserted in the right side of the oil path forming portion 52*a* and the second valve portion 53*b* is inserted in the left side of the oil path forming portion 52*a*.

First and second valve portions 53*a* and 53*b* appropriately open/close the inlets 61 and 65 and the outlets 62 and 64 and the return holes 63 and 66, with outer circumferential surfaces being in sliding contact with the inner circumferential surface of the oil path forming portion 52*a*.

First and second valve portions 53*a* and 53*b* are spaced from each other at the left and right and integrally connected through a connecting portion 53*c*. The connecting portion 53*c* has a rod shape thinner than first and second valve portions 53*a* and 53*b* and is inserted in the left side of the oil path forming portion 52*a* (in the second oil path switching portion 58*b*) together with the second valve portion 53*b*. A ring-shaped space 53*d* is formed between outer circumferential surfaces of the connecting portion 53*c* and the inner circumferential surface of the oil path forming portion 52*a*.

Hereinafter, it is assumed that the right portion of the oil path forming portion 52*a* that accommodates the first valve portion 53*a* when the valve main body 53 moves to the right is a first oil path switching portion 58*a* and the left portion of the oil path forming portion 52*a* that accommodates the second valve portion 53*b* and the connecting portion 53*c* when the valve main body 53 moves to the right is a second oil path forming portion 58*b*.

The first inlet 61, the first leasing hole 62, and the first return hole 63 are open in the first oil path switching portion 58*a* while the second inlet 65, the second outlet 64, and the second return hole 66 are open in the second oil path switching portion 58*b*. In the oil path forming portion 52*a*, the second oil path switching portion 58*b* corresponding to the second oil pump 37 having a relatively large discharge amount has a longitudinal width larger than the first oil path switching portion 58*a* corresponding to the first oil pump 36 having a relatively small discharge amount.

While the valve main body 53 moves to the right, oil can flows in between the right end portion of the first vale portion 53*a* and the right bottom portion of the valve body 52, and the first inlet 61 and the first outlet 62 disposed at the right end in the valve-longitudinal direction of the valve body 52 communicate with each other at the flow portion.

Accordingly, an oil pressure keeps applied from the discharge port 36*c* to the internal space of the first valve portion 53*a*. That is, the internal space of the first valve portion 53*a* is an oil pressure receiving portion 53*e* that keeps receiving the oil pressure from the first oil pump 36. The valve main body 53 is moved to the left against the urging force of the spring 56 by the oil pressure from the first oil pump 36 which the oil pressure receiving portion 53*e* receives.

An extender 53*f* formed in a slight thin cylindrical shape is integrally connected to the left side of the second valve portion 53*b*. The extender 53*f* is inserted in the driving portion 52*b*, with the spring 56 accommodated therein. The extender 53*f* guides extension/contraction of the spring 56 when the valve main body 53 moves. The left end portion of the extender 53*f* is a stopper 53*g* that limits the movement by a predetermined distance or more to the left side of the valve main body 53 by hitting against the end cap 57 when the valve main body 53 moves to the left by a predetermined distance or more.

Referring to FIG. 6, when the valve main body 53 moves to the right, the first inlet 61 and the first outlet 62 communicate with each other while the second inlet 65 and the second outlet 64 communicate with each other through a space 53*d*. In this case, the first return hole 63 is closed to the first valve portion 53*a* and the second return hole 66 is closed to the second valve portion 53*b*.

Figure 8:
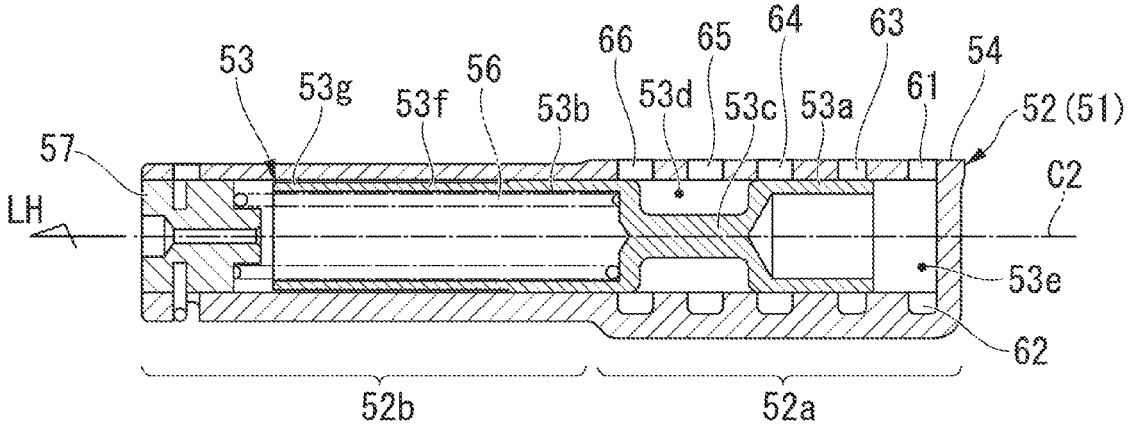
FIG. 8 is a first operation-illustrating view of the oil path switching valve.

Meanwhile, referring to FIG. 8, when the valve main body 53 moves to the left by a predetermined amount, the second outlet 64 is closed to the first valve portion 53*a* while the second inlet 65 and the second return hole 66 communicate with each other through the space 53*d*, with the first inlet 61 and the first outlet 62 communicating with each other. In this case, the second outlet 64 is closed to the first valve portion 53*a*.

Figure 9:
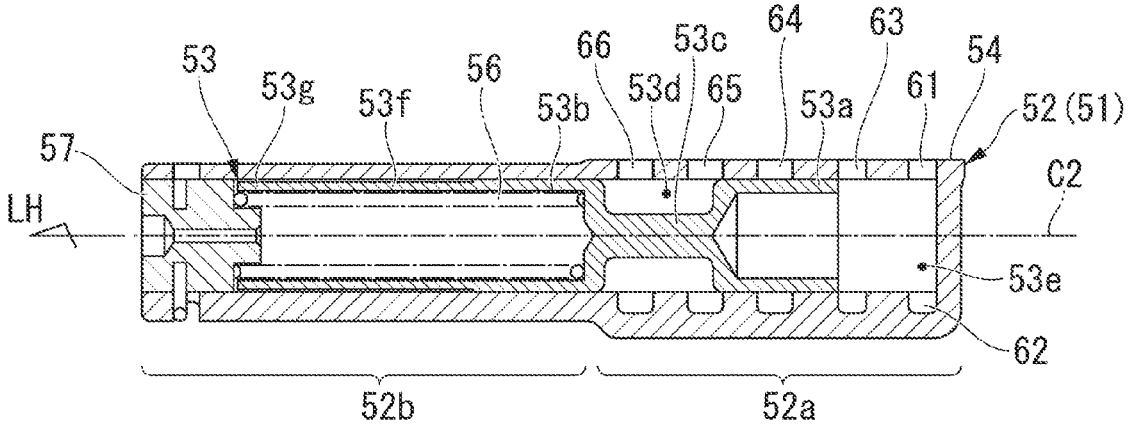
FIG. 9 is a second operation-illustrating view of the oil path switching valve.

Further, referring to FIG. 9, when the valve main body 53 further moves to the left, the first return hole 63 further communicates with the first inlet 61 and the first outlet 62.

Now, when the numbers of revolution of the engine 13 and the oil pump unit 31 are low and the discharge pressure of the first oil pump 36 is low, the valve main body 53 moves not to the left, but to the right (see FIG. 6). In this case, as described above, the first inlet 61 and the first outlet 62 communicating with each other while the second inlet 65 and the second outlet 64 communicate with each other through the space 53*d*. Accordingly, the entire oil pressure from the first and second oil pump 36 and 37 is supplied to the apparatus through the oil supply channel 67.

When the numbers of revolution of the engine 13 and the oil pump unit 31 increase and the discharge pressure of the first oil pump 36 increases from the state described above, the valve main body 53 moves to the left by a predetermined amount by receiving the oil pressure (see FIG. 8). In this case, as described above, the second outlet 64 is closed to the first valve portion 53*a* while the second inlet 65 and the second return hole 66 communicate with each other through the space 53*d*, with the first inlet 61 and the first outlet 62 communicating with each other. Therefore, the entire oil pressure from the first oil pump 36 is supplied to the apparatus through the oil supply channel 67 and the oil pressure from the second oil pump 37 returns to the intake port 37*b* of the second oil pump 37 through the second return channel 66*a*.

Thereafter, when the numbers of revolution of the engine 13 and the oil pump unit 31 further increase and the valve main body 53 further moves to the left, as described above, three portion of the first inlet 61, first outlet 62, and first return hole 63 communicate with each other (see FIG. 9). Accordingly, some of the oil pressure from the first oil pump 36 returns to the intake port 36*b* of the first oil pump 36 through the first return channel 63*a* as a remaining oil pressure. In this sate, the valve main body 53 is prevented from further moving to the left (the valve main body 53 has moved to the left).

Figure 12:
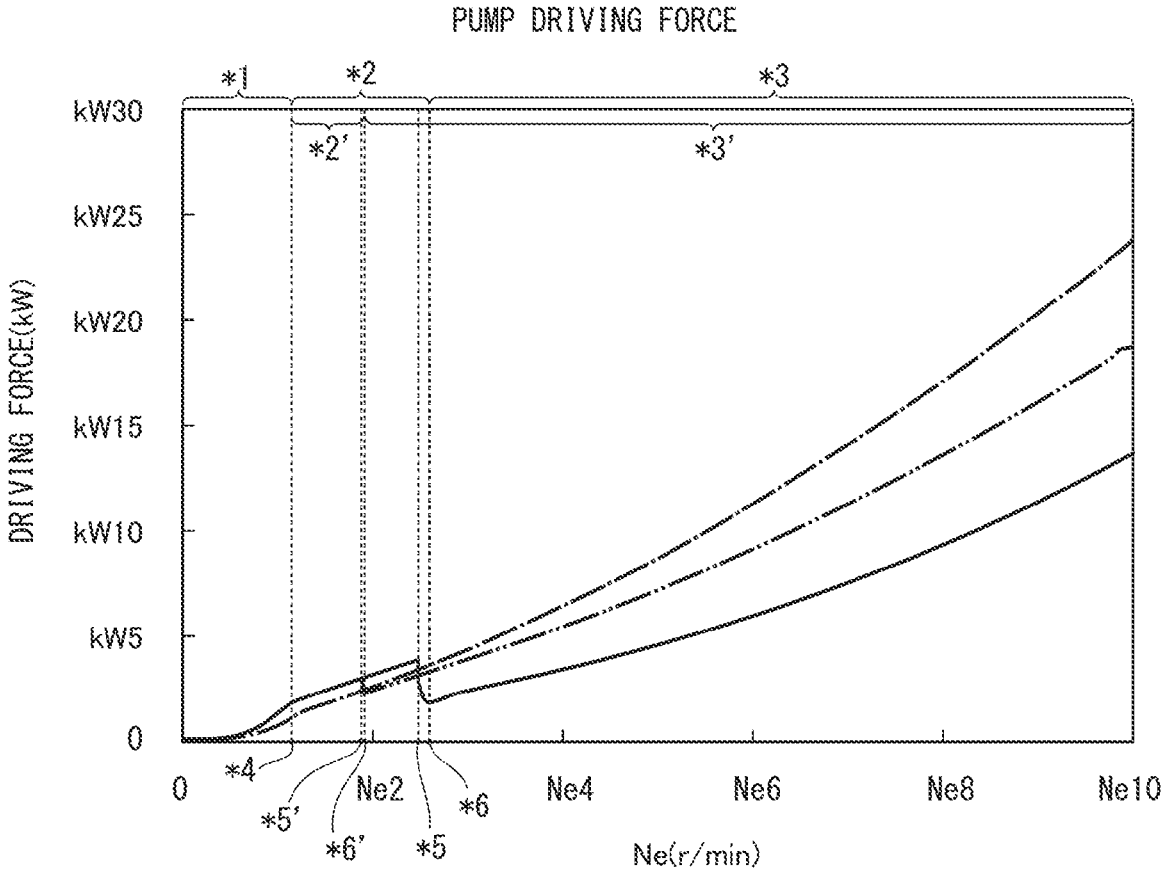
FIG. 12 is a characteristic diagram showing the relationship between the number of revolution of the engine and a pump driving force in the oil pump unit.
Figure 13:
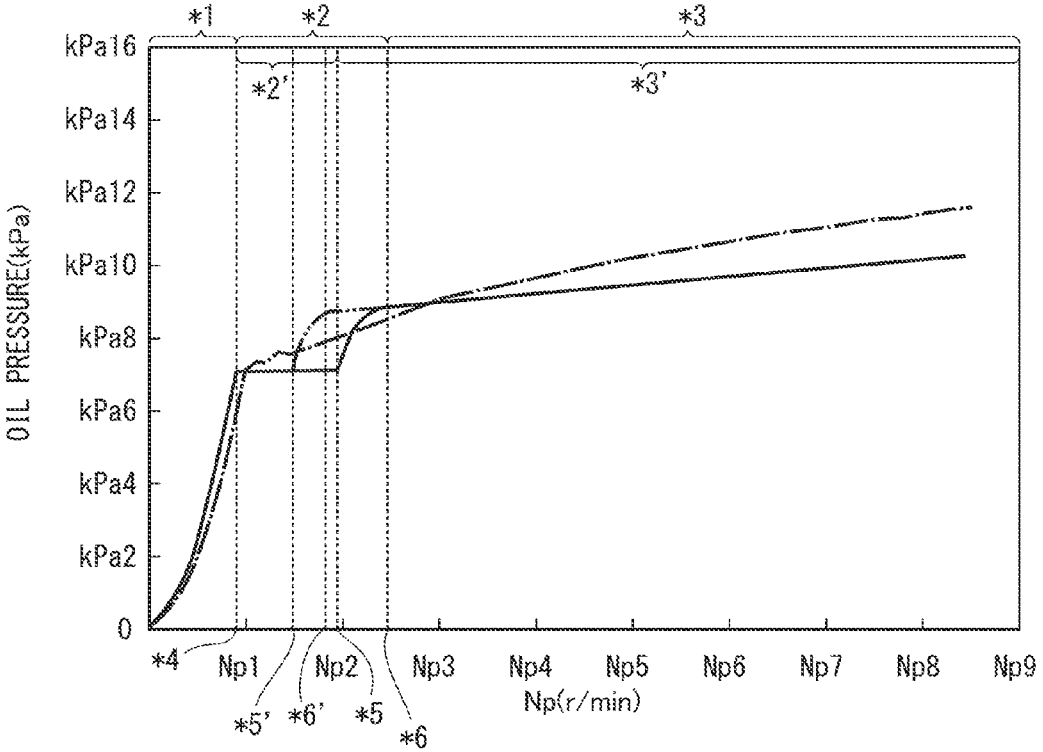
FIG. 13 is a characteristic diagram showing the relationship between the number of revolution of the pump and a generated oil pressure in the oil pump unit.
Figure 14:
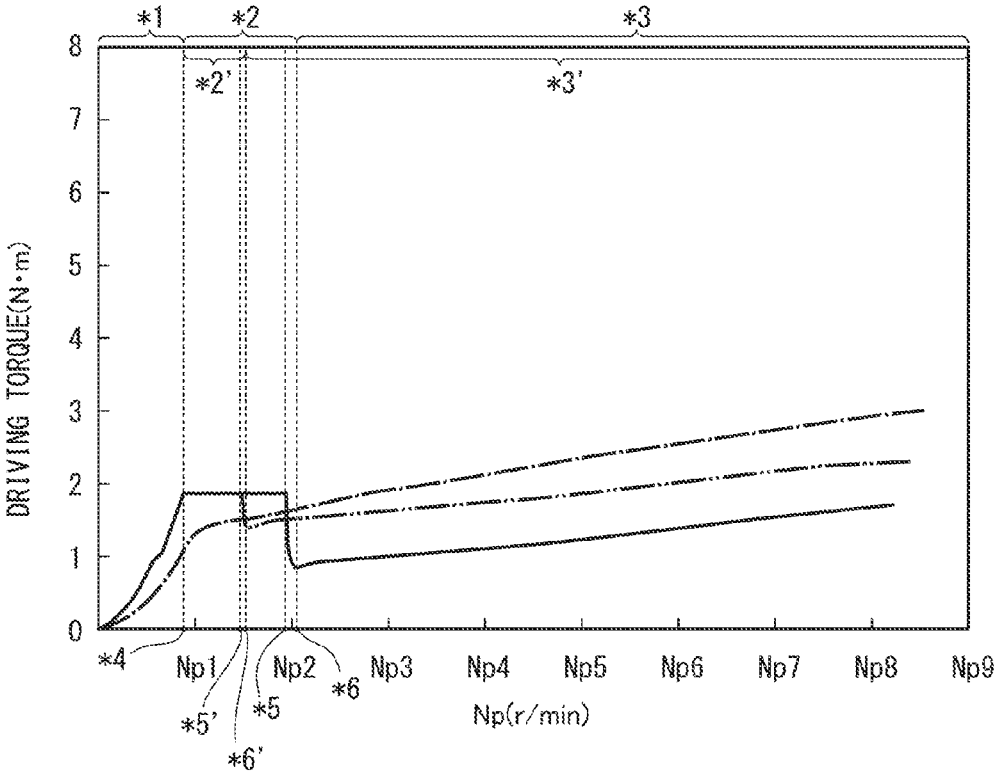
FIG. 14 is a characteristic diagram showing the relationship between the number of revolutions of the pump and driving torque in the oil pump unit.

FIG. 12 is a graph showing the relationship between the number of revolution of the engine 13 (r/min, additionally the number of revolution of the oil pump unit 31) and the pump driving force (kW), FIG. 13 is a graph showing the relationship between the number of revolution (r/min) of the oil pump unit 31 and the generated oil pressure (kPa), and FIG. 14 is a graph showing the relationship between the number of revolution (r/min) of the oil pump unit 31 and the pump driving force (Nm).

In FIGS. 12 to 14, the characteristic line of the oil pump unit 31 of the embodiment (the capacity of the second oil pump 37 is approximately two times the capacity of the first oil pump 36) is shown by a solid line, the characteristic lien when the pump capacities of the first and second oil pumps 36 and 37 are the same is shown by a two-dot chain line, and the characteristic line of the oil pump unit 31 when the oil path switching valve 51 is provided is shown by a one-dot chain line.

Further, in the figures, reference numeral "* 1" indicates a low revolution area where the vale main body 53 of the oil pump unit 31 does not move (has moved to the right), reference numeral "*2" indicates a mid-revolution area where the vale main body 53 of the oil pump unit 31 moves to the left by a predetermined amount, and reference numeral "*3" indicates a high revolution area where the vale main body 53 of the oil pump unit 31 has moved to the left. Further, in the figures, reference numeral "*2'" indicates an area corresponding to the area *2 when the pump capacities of the oil pump 36 and 37 are the same and reference numeral "*3'" indicates an area *3 corresponding to the area when the pump capacities of the oil pump 36 and 37 are the same.

Further, in the figures, reference numeral "*4" indicates the number of revolution where the vale main body 53 of the oil pump unit 31 starts to move, reference numeral "*5" indicates the number of revolution where the second outlet 64 is closed while the second inlet 65 and the second return hole 66 communicate with each other in the oil pump unit 31, and reference numeral "*6" indicates the number of revolution where three portions of the first inlet 61, first outlet 62, and first return hole 63 communicate with each other in the oil pump unit 31. Further, in the figures, reference numeral "*5'" indicates the number of revolutions corresponding to the number of revolutions "*5" when the pump capacities of the oil pump 36 and 37 are the same and reference numeral "*6'" indicates the number of revolutions corresponding to the number of revolutions "*6" when the pump capacities of the oil pump 36 and 37 are the same.

As described above, An oil pump unit with a variable flow rate (an oil pump unit 31) according to the embodiment includes a pump body 38 having intake ports 36*b* and 37*b* and discharge ports 36*c* and 37*c* and accommodating a pump rotor 36*d* and 37*d*, and an oil path switching valve 51 having oil inlets (first and second oil inlets 61 and 65) and oil outlets (first and second oil outlets 62 and 64) and opening/closing oil pressure return holes (first and second return holes 63 and 66) communicating with the discharge port 36*c* and 37*c*, in which, in the oil path switching valve 51, the valve body 52 accommodating the valve main body 53 and the pump body 38 are separately disposed, the intake port 36*b* and 37*b* and the discharge port 36*c* and 37*c* are open to the valve-mounting surface 55 formed at the pump body 38, and oil inlets 61 and 65 and the oil outlet 62 and 64 are open to the body-mounting surface 54 aligned with the valve-mounting surface 55 in the valve body 52.

According to the configuration, in the pump body 38 and the valve body 52, which are separate parts, the intake port 36*b* and 37*b* and the discharge port 36*c* and 37*c* are open to the valve-mounting surface 55 of the pump body 38 while oil inlets 61 and 65 and the oil outlet 62 and 64 are open to the body-mounting surface 54 of the valve body 52, such that it is possible to simultaneously form the intake port 36*b* and 37*b* and the discharge port 36*c* and 37*c* when forming the pump body 38 and simultaneously form oil inlets 61 and 65 and the oil outlet 62 and 64 when forming the valve body 52 and it is not required to dispose a member for close the each openings; therefore, it is possible to improve productivity and reduce the cost and weight by suppressing an increase in the number of the manufacturing processes and the number of parts of the entire pump.

Further, in the oil pump with a variable flow rate, since a plurality of pump rotors 36*d* and 37*d* are disposed on the same shaft, and the intake port 36*b* and 37*b* and the discharge port 36*c* and 37*c*, which correspond to the pump rotors 36*d* and 37*d*, are disposed opposite to each other in the axial direction of the pump, it is possible to dispose the intake port 36*b* and 37*b* and the discharge port 36*c* and 37*c*, which correspond to the pump rotors 36*d* and 37*d* close to each other and it is possible to shorten and simplify the channel between the intake port 36*b* and 37*b* and the discharge port 36*c* and 37*c* and the oil path switching valve 51.

Further, in the oil pump with a variable flow rate, since the oil path switching valve 51 is disposed under a pump driving shaft 32, it is possible to improve air permeability as compared with when the oil path switching valve 51 is disposed above the pump driving shaft 32 and it is also possible to make the valve operability better because the oil collects under the pump (the oil path switching vale 51).

Further, in the oil pump with a variable flow rate, since the pump rotors 36*d* and 37*d* include a first pump rotor 36*d* and a second pump rotor 37*d*, a first oil path switching portion 58*a* that switches the oil path of the first pump rotor 36*d* in the oil path switching valve 51 is disposed at the one side in the valve-longitudinal direction of the valve body 52, and a second oil path switching valve 58*b* that switches the oil path of the second pump rotor 37*d* in the oil path switching valve 51 is disposed at the other end of the oil path switching valve 51 in the valve-longitudinal direction, the first and second oil path switching portions 58*a* and 58*b* are arranged in the valve-longitudinal direction of the valve body 52, and it is possible to not complicate, but to simplify the channel structure of the oil path switching vale 51 and it is also possible to reduce the entire size of the oil path switching valve 51, even if a plurality of pump rotors 36*d* and 37*d* are provided.

Further, in the oil pump with a variable flow rate, since the oil inlet 61 that is kept communicating with the discharge port 36*c* of the first pump rotor 36*d* is disposed at the first oil path switching portion 58*a*, the one valve-longitudinal end of a valve body 53 is disposed facing the oil inlet 61. and an oil pressure receiving portion 53*e* that receives oil pressure from the oil inlet 61 is disposed at the one valve-longitudinal end of the valve body 53, it is possible to improve productivity by making it easy to form the oil pressure receiving portion 53*e* while easily operate the oil path switching valve 51 by using the oil pressure from the first pump rotor 36*d*.

Further, in the oil pump with a variable flow rate, since valve body 53 has a first valve portion 53*a* disposed facing the first oil path switching portion 58*a*, a second valve portion 53*b* disposed facing the second oil path switching portion 58*b*, and a connecting portion 53*c* connecting first and second valve portions 53*a* and 53*b* with each other, first and second valve portions 53*a* and 53*b* open/close oil inlets 61 and 65 and the oil outlet 62 and 64 by bringing outer circumferential surfaces thereof in sliding contact with the inner circumferential surface of the valve body 52, and a space 53*d* through which oil passes is defined between the connecting portion 53*c* and the inner circumferential surface of the valve body 52, it is possible to minutely reduce the weight of the connecting portion 53*c* that connects first and second valve portions 53*a* and 53*b* while integrally operating the valve main body 53 having first and second valve portions 53*a* and 53*b*, and it is also possible to use the space 53*d* outside the connecting portion 53*c* to switch the channel.

Further, in the oil pump with a variable flow rate, since the first valve portion 53*a* is open to the one valve-longitudinal end of the valve body 53 and forms an oil pressure receiving portion 53*e* that receives oil pressure from oil inlets 61 and 65, and the second valve portion 53*b* is open to the other valve-longitudinal end of the valve body 53 and accommodates an coil spring 56 that urges the valve body 53 toward the one valve-longitudinal end, it is possible to make the oil path switching valve 51 compact in the longitudinal direction.

Further, in the oil pump with a variable flow rate, since a cylindrical extender 53*f* that guides extension/contraction by inserting a coil spring that is the coil spring 56 extends from the second valve portion 53*b* and the other valve-longitudinal end of the extender 53*f* is a stopper 53*g* that hits against the valve-longitudinal end of the valve body 52, it is possible to limit the movement of the valve main body 53 to the other end of the valve main body in the longitudinal direction by using the extender 53*f*, and the operation by the coil spring 56 of the valve main body 53 come better.

Further, in the oil pump with a variable flow rate, since the pump rotors 36*d* and 37*d* have different discharge rates, and the valve-longitudinal width of one of the first and second oil path switching portions 58*a* and 58*d*, which corresponds to one of the pump rotors 36*d* and 37*d* which has a larger discharge rate, is larger than the valve-longitudinal width of the other, the oil path switching range of one of the first and second oil path switching portions 58*a* and 58*b* which corresponds to the second pump rotor 37*d* having a large discharge amount increases, such that it is possible to increase the capacity switching width of the entire pump.

Further, the present invention is not limited to the embodiments described above, and may be applied to An oil pump unit with a variable flow rate, for example, having a configuration without the scavenge pump or a configuration in which the control pump includes three or more oil pumps. Further, the present invention is not limited to the V-type engine, and may be applied to various kinds of engines, such as a series type engine or a single-cylinder engine.

Further, the configuration of the embodiments described above is an example of the present invention, which is not limited to a motorcycle (including a bicycle equipped with a power engine a scooter type vehicle), and may be applied to a three-wheel (including a vehicle with two front wheels and one rear wheel, in addition to a vehicle with one front wheel and two rear wheels) or a four-wheel vehicle, such that it can be modified in various ways without departing from the present invention.

While preferred embodiments of the invention have been described and illustrated above, it should be understood that these are exemplary of the invention and are not to be considered as limiting. Additions, omissions, substitutions, and other modifications can be made without departing from present invention. Accordingly, the invention is not to be considered as being limited by the foregoing description, and is only limited by the scope of the appended claims.

What is claimed is:

1. An oil pump unit with a variable flow rate comprising:

a feed oil pump having a first intake port and a first discharge port and accommodating a first pump rotor;

a control oil pump having a plurality of second intake ports, second discharge ports and accommodating a plurality of second pump rotors disposed on a driving shaft; and an oil path switching valve having an oil inlet and an oil outlet and opening/closing oil pressure return holes communicating with the second discharge ports, wherein:

the oil path switching valve and the control oil pump are separately disposed, the second intake ports and the second discharge ports communicate through valve-mounting surfaces formed at the control oil pump, the oil inlet and the oil outlet of the oil path switching valve communicate through body-mounting surfaces matching with the valve-mounting surfaces, the second intake ports and the second discharge ports, which correspond to each of the plurality of second pump rotors, are disposed opposite to each other in an axial direction of the pump driving shaft, the oil path switching valve is disposed under the pump driving shaft, the plurality of second pump rotors include a first control pump rotor and a second control pump rotor, the oil inlet is kept communicating with the discharge port of the first control pump rotor is disposed at a first oil path switching portion that switches an oil path of the first control pump rotor in the oil path switching valve, one valve-longitudinal end of a valve body in the oil path switching valve is disposed adjacent the oil inlet, an oil pressure receiving first valve portion that receives oil pressure from the oil inlet is disposed at the one valve-longitudinal end of the valve body, the valve body has a first valve portion disposed adjacent the first oil path switching portion, a second valve portion disposed adjacent a second oil path switching portion that switches an oil path of the second control pump rotor in the oil path switching valve, and the second valve portion is open to the other valve-longitudinal end of the valve body and accommodates an urging member that urges the valve body toward the one valve-longitudinal end.

2. The oil pump unit with a variable flow rate according to claim 1, wherein:

the valve body has a connecting portion connecting the first and second valve portions with each other;

the first and second valve portions open/close the oil inlet and the oil outlet by bringing outer circumferential surfaces thereof in sliding contact with an inner circumferential surface of the oil path switching valve; and a space through which oil passes is defined between the connecting portion and the inner circumferential surfaces of the oil path switching valve.

3. The oil pump unit with a variable flow rate according to claim 1, wherein:

the urging member is a coil spring;

a cylindrical extender extends from the second valve portion, accommodates the coil spring, and guides an extension/contraction of the coil spring; and the other valve-longitudinal end of the extender is a stopper that hits against said other valve-longitudinal end of the oil path switching valve.

4. The oil pump unit with a variable flow rate according to claim 1, wherein:

one of the first and second control pump rotors has a larger discharge rate than the other one of the first and second control pump rotors; and a valve-longitudinal width of said first and second oil path switching portion, which corresponds to the one of the first and second control pump rotors which has a larger discharge rate is larger than the valve-longitudinal width of the other oil path switching portion.

* * * * *

UNITED STATES PATENT AND TRADEMARK OFFICE

CERTIFICATE OF CORRECTION

PATENT NO. : 9,249,700 B2
APPLICATION NO. : 13/228984
DATED : February 2, 2016
INVENTOR(S) : Keiichi Kai et al.

It is certified that error appears in the above-identified patent and that said Letters Patent is hereby corrected as shown below:

Title Page

Item (73) Assignees:

Change "Kiryu-Shu" to --Kiryu-Shi--

Signed and Sealed this
Twelfth Day of July, 2016

Michelle K. Lee

Michelle K. Lee
*Director of the United States Patent and Trademark Office*